US006998590B2

(12) United States Patent
Reale

(10) Patent No.: US 6,998,590 B2
(45) Date of Patent: Feb. 14, 2006

(54) MICROWAVE COMPONENT HEATING METHOD

(75) Inventor: Anthony Reale, Riverview, MI (US)

(73) Assignee: SPX Corporation, Charlotte, NC (US)

( * ) Notice: Subject to any disclaimer, the term of this patent is extended or adjusted under 35 U.S.C. 154(b) by 0 days.

(21) Appl. No.: 11/045,146

(22) Filed: Jan. 31, 2005

(65) Prior Publication Data

US 2005/0167424 A1 Aug. 4, 2005

Related U.S. Application Data

(62) Division of application No. 10/854,223, filed on May 27, 2004.

(60) Provisional application No. 60/477,943, filed on Jun. 13, 2003.

(51) Int. Cl.
*H05B 6/64* (2006.01)

(52) U.S. Cl. ..... 219/678; 219/679; 219/759; 219/756; 29/6.1

(58) Field of Classification Search ..... 219/678–679, 219/759, 756, 727, 731; 29/6.1–6.2; 126/375, 126/400

See application file for complete search history.

(56) References Cited

U.S. PATENT DOCUMENTS

| | | | | |
|---|---|---|---|---|
| 3,469,053 | A | 9/1969 | Levinson | 219/746 |
| 4,307,277 | A | 12/1981 | Maeda et al. | 219/10.55 R |
| 4,649,607 | A * | 3/1987 | Kuhn, II | 29/6.1 |
| 5,070,223 | A | 12/1991 | Colasante | 219/10.55 M |
| 5,759,486 | A | 6/1998 | Peterson | 422/21 |
| 5,858,303 | A | 1/1999 | Schiffmann et al. | 422/21 |
| 6,147,337 | A | 11/2000 | Besser | 219/730 |
| 6,622,775 | B1 * | 9/2003 | Crafton et al. | 164/131 |

* cited by examiner

*Primary Examiner*—Philip H. Leung
(74) *Attorney, Agent, or Firm*—Baker & Hostetler LLP

(57) ABSTRACT

A system and method for thermally expanding a product submerged in heating medium located in an internal compartment of a microwave oven. The heating medium is subjected to low doses of micro-radiation in order to become heated and thermally expand the encapsulated product.

7 Claims, 4 Drawing Sheets

MICROWAVE COMPONENT HEATING METHOD

FIELD OF THE INVENTION

This application claims priority to and is a divisional of patent application entitled, Microwave Component Heating Apparatus, filed May 27, 2004, having Ser. No. 10/854,223, which claims priority to U.S. provisional patent application entitled, Microwave Component Heating Apparatus and Method, filed Jun. 13, 2003, having Ser. No. 60/477,943, the disclosure of which is hereby incorporated by reference in its entirety.

The present invention relates generally to heating items for thermal expansion. More particularly, the present invention relates to heating tools or components with microwave energy.

BACKGROUND OF THE INVENTION

Manufacturing processes often require the assembly of components in very close fit relation. The tolerance requirements of any clearance space(s) between assembled components is often very small. One technique for assembling such components is by press-fit operation. This process generally requires one component to be fitted within or on another component.

The demand for press-fitting applications is prevalent in a wide variety of industries. In particular, the automobile industry uses components in press-fit applications, for example, in assembly and re-assembly processes. As the machining of individual parts has become more refined, the expected tolerance range between press-fit components has also become smaller.

Applications of press-fit operations may include, for example, press-fitting a cylindrical component onto a shaft. Another application may include press-fitting a bearing component within the orifice of a hub part. Regardless of the specific application, press-fit operations, in general, can be very useful for fitting one component within or onto another component. The aforementioned press-fit operation can be achieved by assembling separate components having very limited clearance space(s). A goal of a press-fit operation is often to achieve a final end product of assembled components while maintaining very small clearance spaces between the assembled components. Another common goal in an assembly/re-assembly processes may be to press-fit separate components together which act as a unitary product in its final assembly.

The clearances between one product and another prior to assembly are often so small as to be virtually zero. Consequently, one part is sometimes heated to expand its size to facilitate the press-fit. A heat gun and/or a heat table are typical devices used to heat a component in order to thermally expand it. A heat gun acts typically to distribute heat to a component, via a flame, in order to achieve thermal expansion. Alternatively, a heating table can be utilized to heat a side of the component by laying the component directly on the table.

Regardless of the equipment being utilized to heat the component, the heating process allows the component to expand a small amount, for example, in order for it to receive another component. Once a component is received, for example, within a receiving core of another component, the receiving core is allowed to cool. During the cooling phase, the core will shrink around the inserted component to a degree which can ultimately achieve a tight fit. This is because the clearance space between the press-fit pieces is reduced as the heated piece cools. In some applications, the cooling process can occur such that any clearance space between the two separate members becomes nearly zero. Thus separate components subjected to a press-fit operation may essentially become a unitary member.

While the use of heat guns heating tables are typically known to those of ordinary skill in the art, the use of such items contain certain disadvantages. For instance, uniform heating of a component can not generally be achieved through use of either a heat gun or heating table. This is, in part, because the component is only heated from one side using these various methods. Hence, thermal expansion is not allowed to occur evenly amongst or throughout the structure of the component. This, in effect, can produce an irregular shape in the component when it thermally expands. Such an irregular shape could ultimately affect any clearance space(s) between press-fit components such that the required tolerances would not be achieved, and hence, the assembled components would contain an assembly defect at least to some degree.

Another disadvantage of using heat guns or heating tables is that the use of such warrants a limited amount of working time to actually perform the press-fit operation once a component has been heated using these methods. Rapid cooling can occur once the thermal application of a heat source is removed from a heated component. Hence, a small window of available time exists to perform the press-fit operation and to take advantage of the thermal expansion properties of the component.

As the technology to machine components becomes more precise it is increasingly important to achieve prescribed tolerances during press-fit operations. Any irregularities between press-fit components, even on a minute level, can sometimes impinge upon whether a press-fit operation is successful. The result of assembling defective press-fit components can waste valuable resources including, for example, time, energy, and the materials of the defective product itself. The aforementioned may also translate into lost revenue consumed by processing and placing defective products.

Accordingly, a need exists therefore, for providing a method and apparatus for providing at least somewhat uniform heating to a component in order to achieve thermal expansion for use, for example, in press-fit operations.

Additionally, a need exists therefore, for providing a method and apparatus for providing a desirably long working available time of a component having a thermal expansion for use, for example, in press-fit operations.

SUMMARY OF THE INVENTION

The foregoing needs are met, to a great extent, by the present invention, wherein in one aspect an apparatus for thermally expanding an item is provided that includes an oven having an internal compartment. A heating medium is located in the internal compartment and adapted to contact and at least partially surround the item. A door is also provided to close the internal compartment.

In accordance with another embodiment of the present invention, a system for thermally expanding an item is provided including a means for emitting energy having an internal compartment. The system also includes a means for receiving the energy to produce heat and for contacting and at least partially surrounding the item. A means for closing the internal component is also provided.

In accordance with yet another embodiment of the present invention, a method of thermally expanding an item is provided including providing an oven having an internal compartment, filling the internal compartment with a heating medium, submerging the item at least partially in the heating medium, and heating the heating medium to thermally expand the item.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
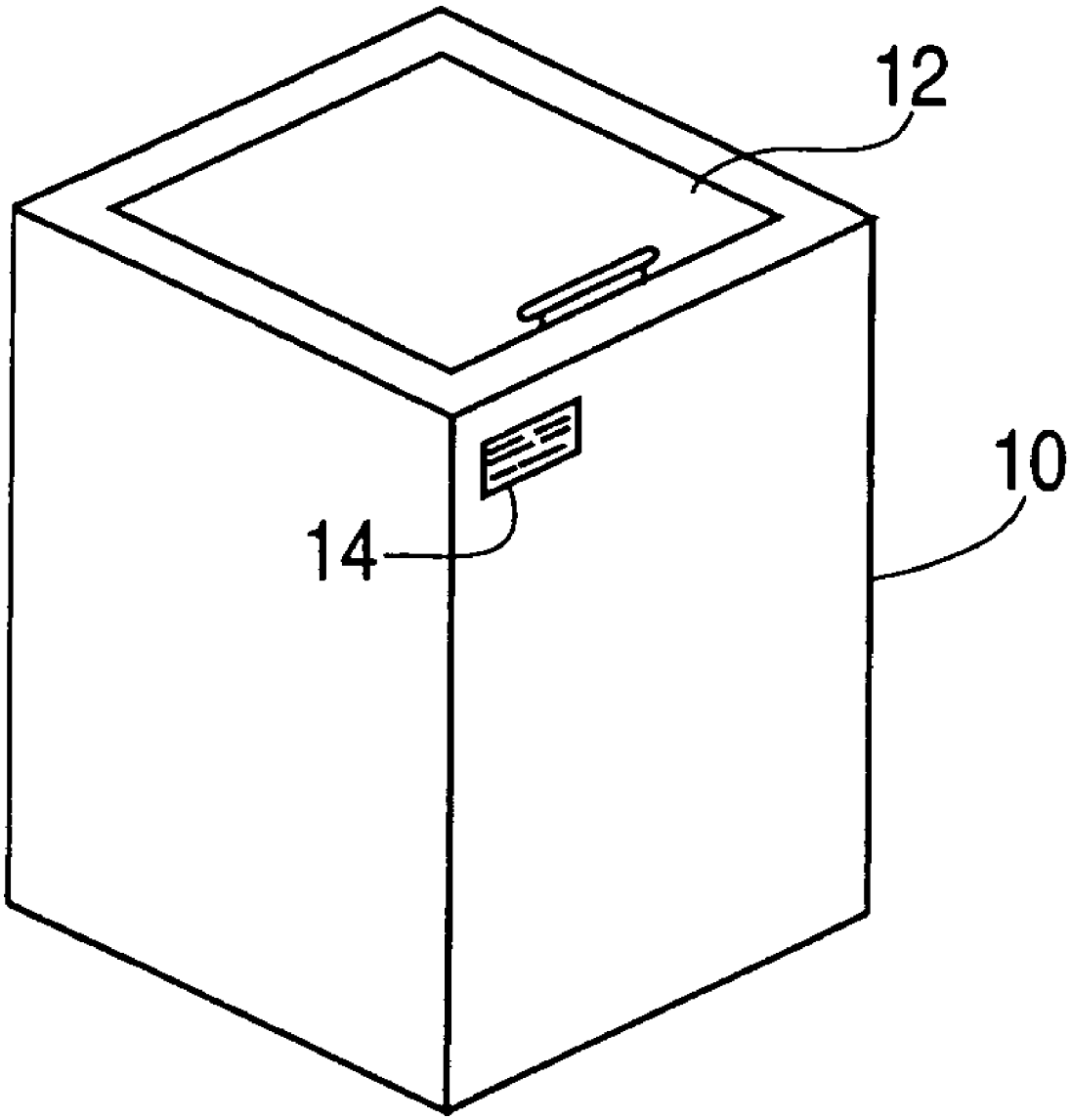
FIG. 1 is a perspective view illustrating a top loading microwave oven according to a preferred embodiment of the invention.

An embodiment in accordance with the present invention provides a method and apparatus for providing heating to components in order to achieve thermal expansion for use, for example, in press-fit operations. The present invention also provides a method and apparatus for providing a desirable degree of available working time of a thermally expanded component for use, for example, in press-fit operations. The invention will now be described with reference to the drawing figures, in which like reference numerals refer to like parts throughout.

One example of an apparatus for providing uniform heating to components includes a microwave oven. An embodiment of the present inventive apparatus and method is illustrated in FIG. 1. The preferred embodiment of the invention includes a microwave 10 preferably constructed to feature a top-load design. Such construction can include, for example, a door 12 which is attached to the top of the microwave 10 for access to an internal compartment 16 of the microwave. A programmable interface 14 may be utilized to program the microwave 10. Such programmable settings may include, for example, an operating time of the microwave 10 or a power setting of the microwave 10.

Figure 2:
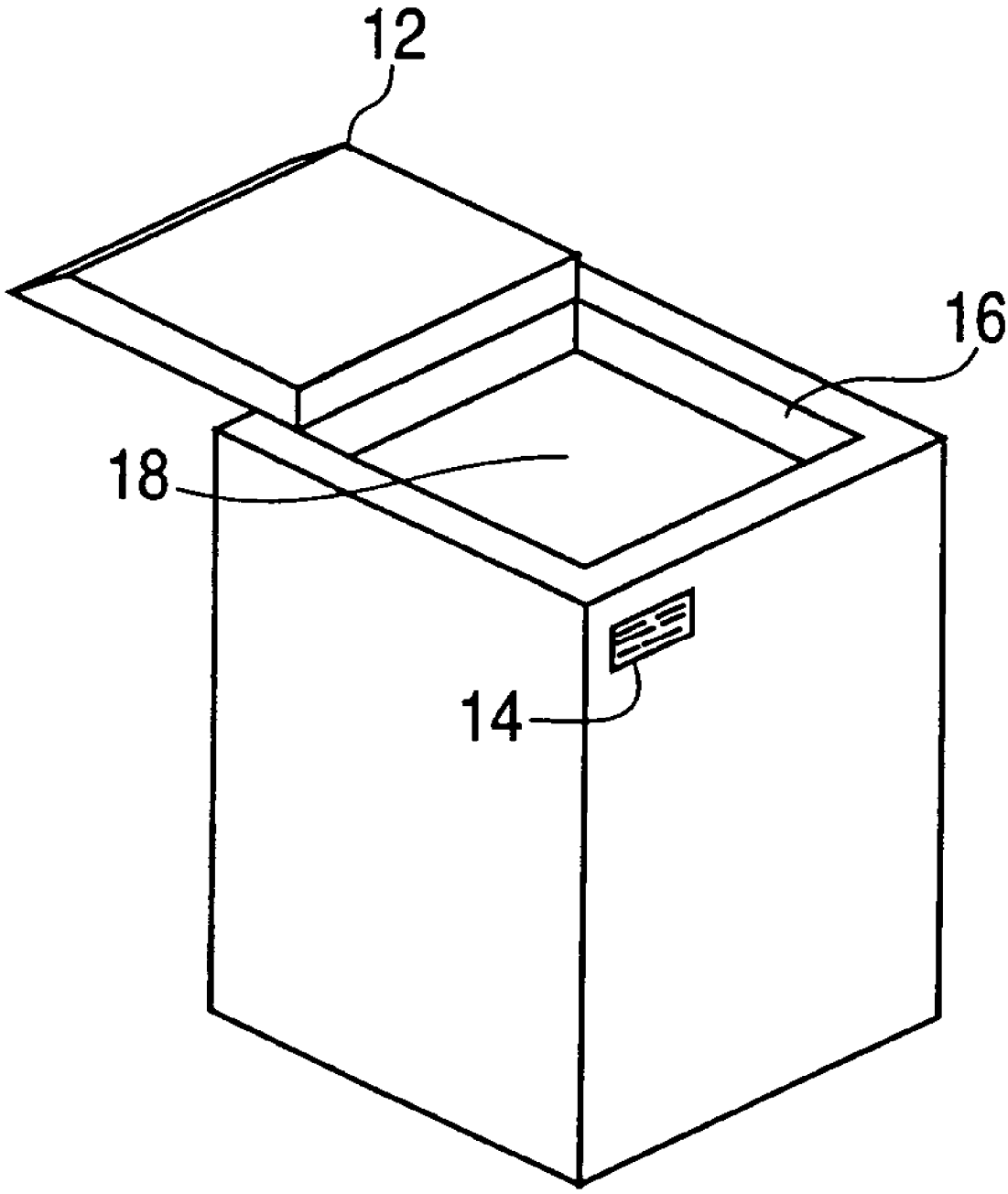
FIG. 2 is a perspective view illustrating a top loading microwave oven containing a heating medium according to a preferred embodiment of the invention.

FIG. 2 illustrates the door 12 in an open configuration which provides access to an internal compartment 16 of the microwave 10. In a preferred embodiment of the invention, the internal compartment 16 of the microwave 10 may be filled with a heating medium such as, for example, a microwaveable gel 18.

Figure 3:
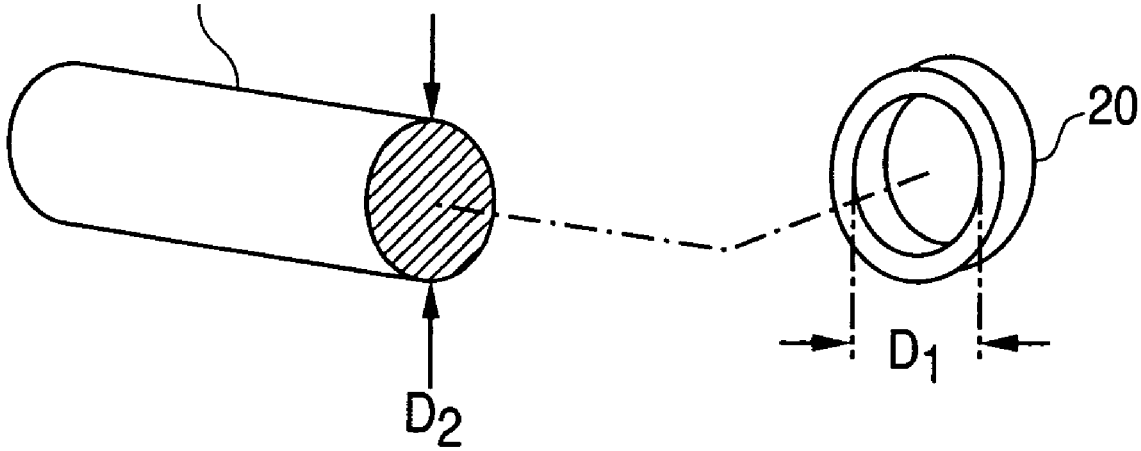
FIG. 3 is a perspective view illustrating an outer component and an inner component heated by the heating medium of FIG. 2.

An example of a product to be heated and utilized in a press-fit operation is illustrated in FIG. 3. A first component 20 having an inner diameter $D_1$ is similar in diameter to the outer diameter $D_2$ of a second component 22. In order to fit the outer diameter $D_2$ of the second component 22 over the inner diameter $D_1$ of the first component 20, the first component may be thermally expanded to allow the inner diameter $D_1$ to be expanded by some amount.

Figure 4:
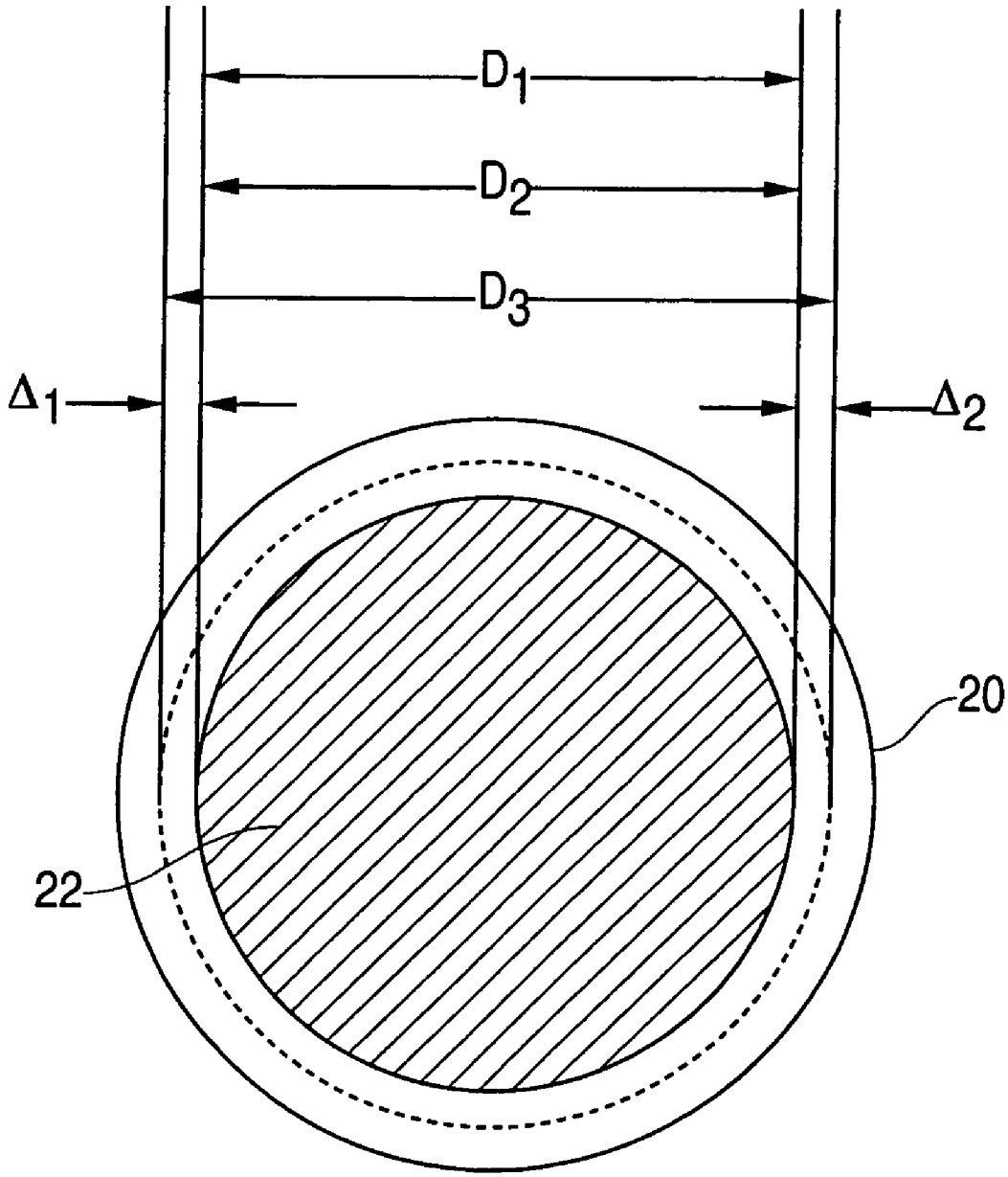
FIG. 4 is an end view illustrating the inner and outer components of FIG. 3.

FIG. 4 illustrates the second component 22 having been press-fitted within the inner diameter $D_1+\Delta_1+\Delta_2$ of the first component 20. In a state of thermal expansion, the inner diameter $D_1+\Delta_1+\Delta_2$ of the first component is larger than the outer diameter $D_2$ of the second component 22. Thus, the second component 22 may readily fit within the orifice of the thermally expanded first component 20. Upon being subjected to a cooling process, the thermally expanded inner diameter $D_1+\Delta_1+\Delta_2$ of the first component 20 will eventually shrink around the outer diameter $D_2$ of the second component 22 to form a press-fit assembly. Hence, any difference between the diameters of the cooled first component 20 and that of the second component 22 can be near zero if desired.

In order to achieve the thermal expansion of the first component 20, the first component 20 is exposed to a source of heat for a prescribed amount of time. It is typically preferable to expand the first component 20 evenly and in an undeformed manner at least to some extent.

The present invention achieves substantially even expansion of a component, to a great extent, by submerging the first component 20 in a heating medium and heating the heating medium, which completely encapsulates the first component 20, to provide relatively uniform heating to the entire surface area of the first component 20. One example of a heating medium can include a microwaveable gel 18. Preferably, the microwaveable gel is a petroleum based gel. The properties of the petroleum based gel have the additional benefit of tending to provide additional lubrication of the components during the press-fit operation.

Turning again to FIG. 2, an internal compartment 16 of a the microwave oven 10 is filled with the heating medium such as a petroleum based microwaveable gel 18. The first component 20 is submerged within the microwaveable gel 18. After the lid 12 is secured, the microwave 10 is turned on for a prescribed period of time. The microwaveable gel 18 is subjected to low doses of pulse micro-radiation which, in turn, heat the gel 18 and, thus, cause the first component 20 to become heated and to thermally expand.

In general, microwave ovens use microwaves to heat products. Microwaves are radio waves and, in the case of ovens, commonly used a radio wave frequency of roughly 2,500 megahertz (2.5 gigahertz). Radio waves in this frequency range are absorbed by water, fats, and sugars. When they are absorbed, they are converted directly into atomic motion—heat. Microwaves in this frequency range are also not absorbed by most plastics, glass, or ceramics.

Additionally, metal objects reflect microwaves in this frequency range. Many components to be press-fit are metal. In those instances, the properties of metal objects, such as the first component 20, utilized within the microweavable gel 18 can be advantageously utilized in a preferred embodiment of the invention. Because metals reflect microwaves (such as those utilized by the present invention), the microwaves passing throughout the microwaveable gel 18 will reflect off of the metal first component 20 and back into the microwaveable gel 18. Hence, the area of microwaveable gel 18 directly around the first component 20 will, in some cases, become superheated relatively quickly and, hence, raise the temperature of the submerged first component 20 rapidly.

The phenomenon of thermally expanding a product, at least to some extent evenly, takes place, in part, due to the characteristics of microwaves, i.e., heating is generally occurring to some extent everywhere all at once throughout the heating medium (such as the microwaveable gel 18) which causes, in some examples, relatively even heating throughout the component 20. The molecules of the heating medium, such as the microwaveable gel 18, are generally excited all together. In the arrangement of the present invention, the surface area of the submerged object, such as the first component 20, is also generally heated evenly by the even rise in temperature of the surrounding heating medium.

After the heating medium is heated sufficiently, the first component 20 is removed from the gel bath. Typically in some examples, a small amount of residual microwaveable gel 18 will remain on the object. This residual amount of microwaveable gel 18 acts as a thermal buffer layer and allows for additional time of the press-fit operation to be performed by retaining heat, circulating the object, and/or otherwise delaying the cooling effects of the thermal expansion. As mentioned above, the residual amount of microwaveable gel 18 also acts in some instances as a lubricant for the assembled components during the press-fit operation.

Once the first component 20 is removed from the gel bath, it is preferable to promptly begin the press-fit operation. Although an example of a microwave oven is depicted in FIGS. 1–2, it will be appreciated that other devices capable of heating a heating medium may also be used, whether by generating pulse micro-radiation or by other heating systems. Additionally, although a sleeve component 20 and staff component 22 are illustrated for example, it will be further appreciated that other components requiring thermal expansion may be utilized in the heating medium for press-fit operations.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A method of thermally expanding a metal item, comprising:

providing a microwave oven having an internal compartment;

filling the internal compartment with a heating medium gel;

submerging the metal item at least partially in the heating medium gel; and heating the heating medium gel by microwave energy to thermally expand the metal item.

2. The method of claim 1, wherein the heating step comprises subjecting the heating medium to low doses of micro-radiation.

3. The method of claim 1, wherein the heating medium gel is microwaveable.

4. The method of claim 3, wherein the microwaveable gel is petroleum based.

5. The method of claim 1, further comprising: sealing the internal compartment.

6. The method of claim 5, further comprising: unsealing the internal compartment and removing the metal item from the internal compartment of the oven after it has been thermally expanded.

7. The method of claim 6, further comprising: utilizing the thermally expanded product in a press-fit operation.

* * * * *